US006386168B2

(12) United States Patent
Suzuki et al.

(10) Patent No.: US 6,386,168 B2
(45) Date of Patent: May 14, 2002

(54) VALVE CAM MECHANISM FOR FOUR-CYCLE ENGINE

(76) Inventors: Hiroyuki Suzuki; Yasuhiko Shibata, both of 2500 Shingai, Iwata, Shizuoka 438-8501 (JP)

( * ) Notice: Subject to any disclaimer, the term of this patent is extended or adjusted under 35 U.S.C. 154(b) by 0 days.

(21) Appl. No.: 09/759,608

(22) Filed: Jan. 12, 2001

(30) Foreign Application Priority Data

Jan. 12, 2000 (JP) ..... 2000-003380

(51) Int. Cl.[7] ..... F01L 13/08

(52) U.S. Cl. ..... 123/182.1; 123/182.1; 123/179.22

(58) Field of Search ..... 123/90.16, 90.17, 123/179 SE, 179.22, 182, 185.3, 182.1

(56) References Cited

U.S. PATENT DOCUMENTS

| | | | | |
|---|---|---|---|---|
| 2,530,623 A | | 11/1950 | Martin | |
| 4,453,507 A | | 6/1984 | Braun et al. | |
| 4,570,584 A | | 2/1986 | Uetsuji et al. | |
| 4,590,905 A | * | 5/1986 | Matsuki et al. | 123/321 |
| 5,150,674 A | | 9/1992 | Gracyalny | |
| 5,687,683 A | * | 11/1997 | Knoblauch | 123/182.1 |
| 5,816,208 A | | 10/1998 | Kimura | |

* cited by examiner

*Primary Examiner*—Thomas Denion
*Assistant Examiner*—Jaime Corrigan
(74) *Attorney, Agent, or Firm*—Knobbe, Martens, Olson & Bear, LLP

(57) ABSTRACT

A valve cam mechanism for a four-cycle engine includes an improved construction. The engine includes at least one camshaft having cam lobes to actuate intake and exhaust valves. A decompression actuator is affixed to the camshaft for pivotal movement. A holder section of the actuator is arranged to hold the intake or exhaust valve in an open position when the actuator exists in an initial position. A weight section is disposed opposite to the holder section relative to the pivot axis to place the holder section in the initial position. The actuator pivots when the weight section moves by centrifugal force to release the holder section from the initial position. The camshaft further has a projection extending radially and defining a first surface on which the stopper section abuts to inhibit the actuator from pivoting beyond a preset range. The cam lobe includes a base circle portion and a nose portion protruding from the base circle of the cam lobe. The nose portion is cured to be harder than the base circle portion. The base circle portion defines a second surface projecting toward the actuator. The holder section abuts on the second surface when the actuator lies in the initial position. The side surface is finished by a machining process.

12 Claims, 7 Drawing Sheets

VALVE CAM MECHANISM FOR FOUR-CYCLE ENGINE

PRIORITY INFORMATION

This invention is based on and claims priority to Japanese Patent Applications No. 2000-3380, filed Jan. 12, 2000, the entire contents of which is hereby expressly incorporated by reference.

BACKGROUND OF THE INVENTION

1. Field of the Invention

This invention relates to a valve cam mechanism for a four-cycle engine, and more particularly to an improved valve cam mechanism that decompresses a combustion chamber for easy starting of a four-cycle engine.

2. Description of Related Art

All internal combustion engines have a starting mechanism. In many applications, the starting mechanism is an electrical device that is operable with a key by the operator. This device provides a simple way to start the engine. Some simpler engines however, use a manual starting device in order to keep the engine compact. For instance, it is frequently the practice in outboard motors, and particularly those of small displacement, to incorporate a mechanism whereby the engine may be manually started. This is normally done by a rope or recoil starter that is associated with a flywheel disposed atop the crankshaft of the engine.

In order to achieve good engine performance it is a practice to use relatively high compression ratios. The use of such high compression ratios, however, gives rise to a rather large force that must be overcome by the operator to effect manual starting. There have been, therefore, proposed types of decompression mechanisms which effectively lower the compression ratio of the engine during the manual starting procedure. Preferably, such devices are automatic in nature wherein the compression ratio is lowered only long enough to facilitate starting and not long enough to interfere with the running of the engine once starting has been accomplished. That is, the decompression mechanism must be released promptly when engine is started and not work above a selected idle engine speed.

Occasionally, engines such that provided on, for example, outboard motors and lawn mowers may have camshafts extending generally vertically. One of proposed decompression mechanisms for these engines has a construction in which an actuator is mounted on a camshaft for pivotal movement about a pivot axis extending generally normal to an axis of the camshaft. The actuator may have a holder section which is arranged to hold, for example, an exhaust valve in an open position when the actuator exists in an initial position. If the engine has a rocker arm which is periodically lifted by the camshaft to actuate the exhaust valve, the holder section holds the rocker arm instead of directly holding the exhaust valve. The actuator also has a weight section that places the holder section in the initial position by the gravity, i.e., by its own weight, and moves by the centrifugal force produced by rotation of the camshaft so as to release the holder section from holding the exhaust valve in the open position.

When the holder section is in the initial position because the camshaft stands still, the exhaust valve is held in the open position in which a combustion chamber of the engine communicates with the atmosphere. Because no compression force is developed in the combustion chamber under this condition, the operator can manually start the engine.

Once the engine starts, the camshaft rotates and the actuator is released from the initial position by the movement of the weight section. The combustion chamber no longer communicates with the atmosphere under this condition and normal running of the engine is thus assured. U.S. Pat. Nos. 4,453,507 and 5,150,674 disclose such decompression mechanisms in which actuators directly hold valves when starting engines.

The weight section of the actuator disclosed in U.S. Pat. No. 5,150,674, however, may cause an unexpected contact with a cam follower of the valve and if this occurs the valve may not be seated properly at the valve seat. U.S. Pat. No. 4,453,507 shows an actuator which includes a stopper section that abuts on a surface of a cam gear so as to inhibit the actuator from pivoting beyond a preset range. Because of this construction, neither the holder section nor the weight section can contact with the cam follower or the cam lobe. However, this construction may undesirably cause valve closing because the holder section can be distorted by the urging force of a valve spring that pushes the holder section when the actuator is in the initial position. If the distortion of the holder section occurs, the necessary space for the decompression, which is made between the valve and the valve seat, no longer is properly maintained. The construction disclosed in U.S. Pat. No. 5,150,674 also may have this disadvantage.

Another construction has been proposed in co-pending application Ser. No. 09/498,571 filed Feb. 4, 2000 in the name of Hiroyuki Suzuki and Kenji Yukishima and assigned to the assignee hereof. In this proposed construction, the holder section abuts on a side surface of a cam lobe of the camshaft. Distorting force, if any, exerting onto the holder section can be certainly received by the cam lobe and the necessary space can be accurately kept.

This construction, however, raises a problem that a manufacturing cost of the camshaft can increase. This is because the cam lobes are usually hardened so as to be harder than the other part of the camshaft for inhibiting wearing. Meanwhile, the side surface where the holder section abuts must be machined so that a space between the valve and the valve seat is accurately set when the holder section lifts the valve. That is, if the side surface is roughly finished, then the distance of the space can be larger or smaller than a preferred distance. This machining can be difficult because the cam lobes are hardened. A need therefore exists for an improved decompression mechanism that is less expensive to manufacture.

SUMMARY OF THE INVENTION

In accordance with one aspect of the present invention, an internal combustion engine comprises a cylinder block defining at least one cylinder bore. A piston reciprocates in the cylinder bore. A cylinder head member closes one end of the cylinder bore and defines a combustion chamber with the cylinder bore and the piston. An intake passage has an intake port through which air is introduced into the combustion chamber. An intake valve is arranged to open and close the intake port. An exhaust passage has an exhaust port through which exhaust products are discharged from the combustion chamber. An exhaust valve is arranged to open and close the exhaust port. At least one camshaft extends generally vertically. The camshaft is arranged for rotation and has cam lobes to actuate the intake valve and the exhaust valve. A decompression actuator is affixed to the camshaft for pivotal movement about a pivot axis extending generally normal to an axis of the camshaft. The actuator includes a holder section, a weight section and a stopper section. The holder section is arranged to hold the intake valve or the exhaust valve in an open position when the actuator exists in an initial position. The weight section is disposed opposite to the holder section relative to the pivot axis so as to place the holder section in the initial position. The actuator pivots when the weight section moves by centrifugal force produced by the rotation of the camshaft so as to release the holder section from the initial position. The camshaft further has a projection extending radially from the camshaft and defining a first surface on which the stopper section abuts so as to inhibit the actuator from pivoting beyond a preset range. At least the cam lobe associated with the intake valve or the exhaust valve held by the holder section includes a base circle portion and a nose portion. The base circle portion has a diameter which defines the base circle of the cam lobe. The nose portion protrudes from the base circle so as to lift the associated intake valve or the exhaust valve. The nose portion is harder than the base circle portion. The base circle portion defines a second surface projecting toward the actuator. The holder section abuts the second surface when the actuator lies in the initial position. The second surface is finished by a machining process.

In accordance with another aspect of the present invention, an internal combustion engine comprises a cylinder block defining at least one cylinder bore. A piston reciprocates in the cylinder bore. A cylinder head member closes one end of the cylinder bore and defines a combustion chamber with the cylinder bore and the piston. An intake passage has an intake port through which air is introduced into the combustion chamber. An intake valve is arranged to open and close the intake port. An exhaust passage has an exhaust port through which exhaust products are discharged from the combustion chamber. An exhaust valve is arranged to open and close the exhaust port. At least one camshaft extends generally vertically. The camshaft is arranged for rotation and has cam lobes to actuate the intake valve and the exhaust valve. A decompression actuator is affixed to the camshaft for pivotal movement about a pivot axis extending generally normal to an axis of the camshaft. The actuator includes a holder section and a weight section. The holder section is arranged to hold the intake valve or the exhaust valve in an open position when the actuator exists in an initial position. The weight section is disposed opposite to the holder section relative to the pivot axis so as to place the holder section in the initial position. The actuator pivots when the weight section moves by centrifugal force produced by the rotation of the camshaft so as to release the holder section from the initial position. The actuator and the camshaft together define means for inhibiting the actuator from pivoting beyond a preset range. At least the cam lobe associated with the intake valve or the exhaust valve held by the holder section includes a base circle portion and a nose portion. The base portion has a diameter which defines the base circle of the cam lobe. The nose portion protrudes from the base circle so as to lift the associated intake valve or the exhaust valve. The nose portion is harder than the base circle portion. The base circle portion defines a surface projecting toward the actuator. The holder section abuts on the surface when the actuator exists in the initial position. The surface is finished by a machining process.

In accordance with a further aspect of the present invention, a valve cam mechanism for a four-cycle engine having a combustion chamber comprises a valve arranged to open and close the combustion chamber to the atmosphere. A camshaft extends generally vertically. The camshaft is arranged for rotation and has a cam lobe to actuate the valve. A decompression actuator is affixed to the camshaft for pivotal movement about a pivot axis extending generally normal to an axis of the camshaft. The actuator includes a holder section and a weight section. The holder section is arranged to hold the valve in an open position when the actuator exists in an initial position. The weight section is disposed opposite to the holder section relative to the pivot axis so as to place the holder section in the initial position. The actuator pivots when the weight section moves by centrifugal force produced by the rotation of the camshaft so as to release the holder section from the initial position. The actuator and the camshaft together define means for inhibiting the actuator from pivoting beyond a preset range. The cam lobe includes a base circle portion and a nose portion. The base circle portion has a diameter which defines the base circle of the cam lobe. The nose portion protrudes from the base circle so as to lift the associated valves. The nose portion is cured so as to be harder than the base circle portion. The base circle portion defines a surface projecting toward the actuator. The holder section abuts on the surface when the actuator exists in the initial position. The surface is finished by a machining process.

Further aspects, features and advantages of this invention will become apparent from the detailed description of the preferred embodiment which follows.

BRIEF DESCRIPTION OF THE DRAWINGS

These and other features, aspects and advantages of the present invention will now be described with reference to the drawings of a preferred embodiment which is intended to illustrate and not to limit the invention. The drawings comprise nine figures.

DETAILED DESCRIPTION OF THE PREFERRED EMBODIMENT OF THE INVENTION

Figure 1:
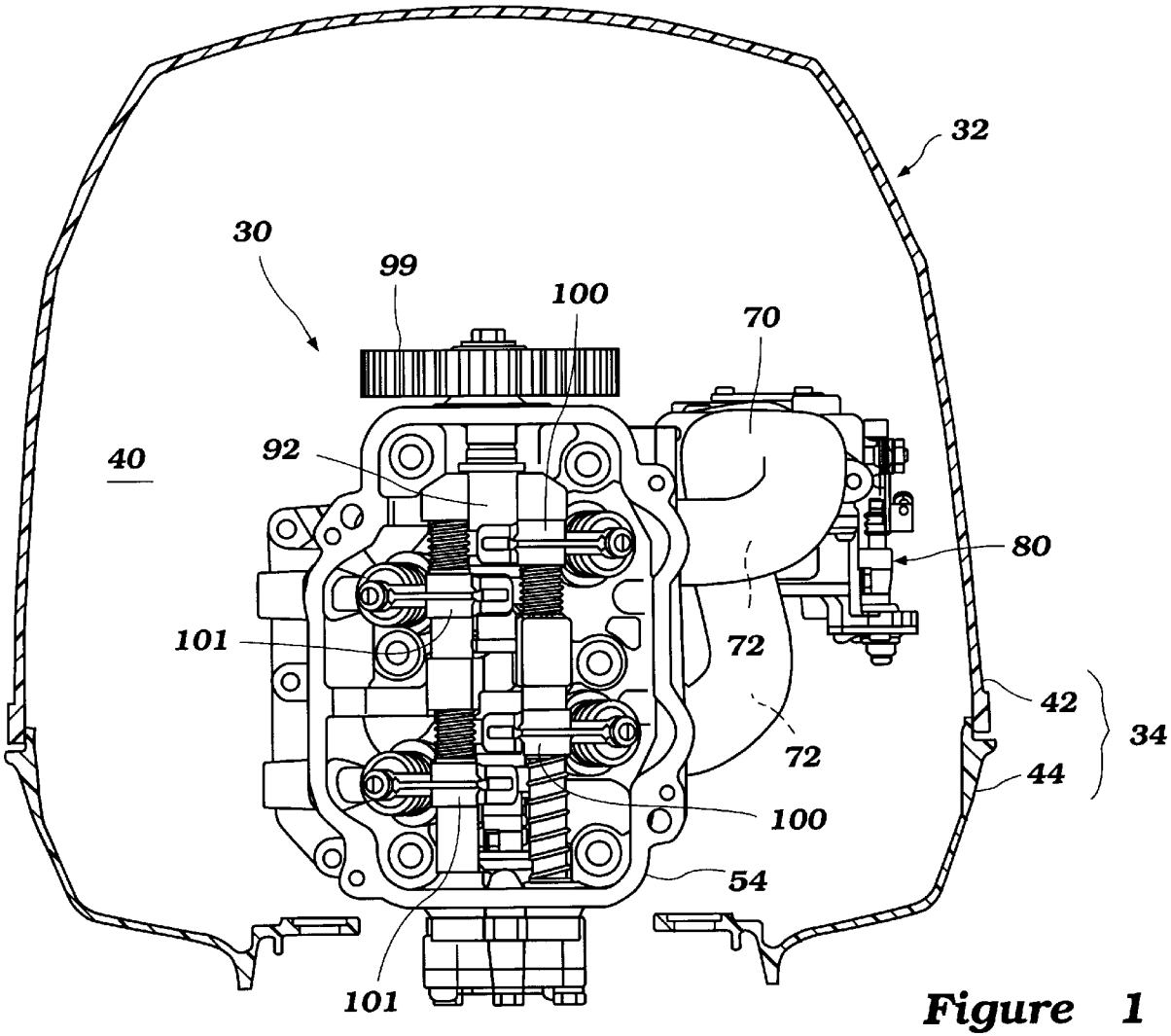
FIG. 1 is a rear view of a power head employing a decompression mechanism arranged in accordance with a preferred embodiment of the present invention. An engine is shown without a cylinder head cover. A protective cowling is shown in section.
Figure 2:
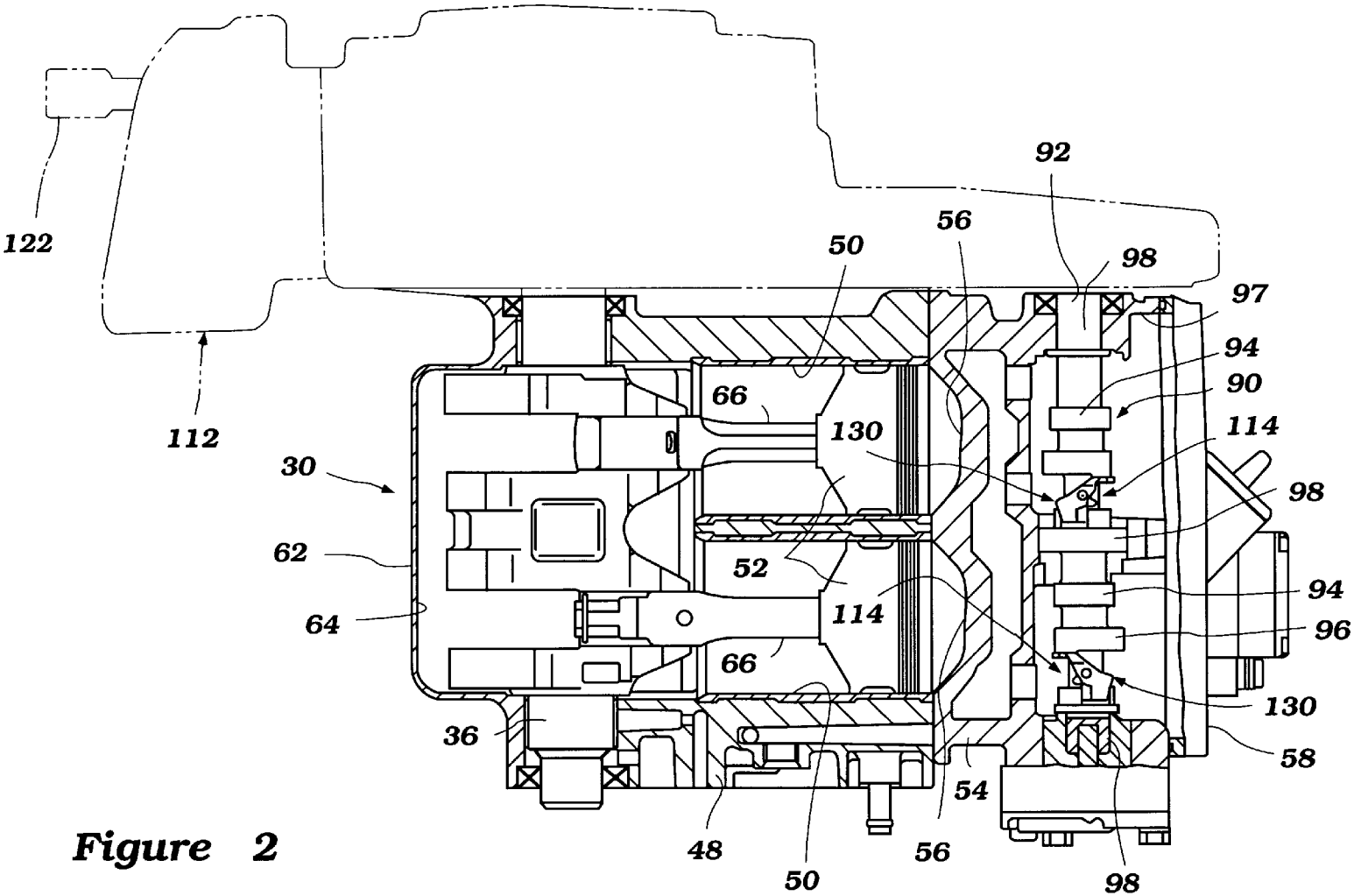
FIG. 2 is a side elevational view of the engine. A large portion of the engine, except for a manual starter assembly and a portion of the cylinder head cover, is shown in section. The manual starter assembly is shown in phantom.
Figure 3:
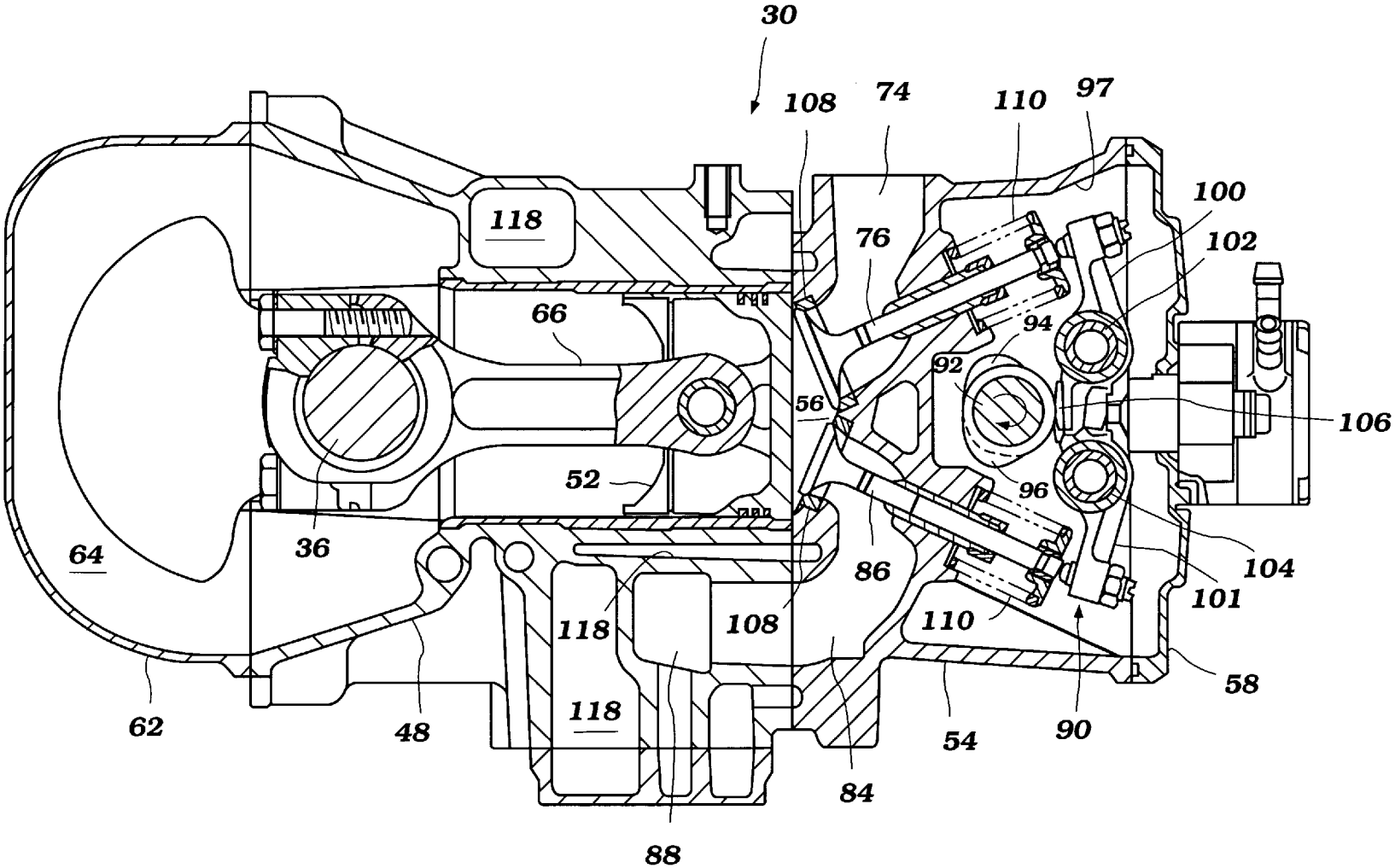
FIG. 3 is a top plan view of the engine. The engine is shown in section.

With reference to FIGS. 1–3, an overall construction of an engine 30 for an outboard motor, which employs a decompression mechanism configured in accordance with a presently preferred arrangement of the present invention, will be described.

Although the present invention is shown in the context of an engine for an outboard motor, various aspects and features of the present invention also can be employed with engines used in other types of marine drives (e.g., a stem drives and in-board/out-board drives) and also, for example, with engines used in land vehicles, such a lawn mower.

The outboard motor comprises a drive unit and a bracket assembly. The bracket assembly supports the drive unit on a transom of an associated watercraft so as to place a marine propulsion device in a submerged position with the watercraft resting on the surface of a body of water. The bracket assembly comprises a swivel bracket, a clamping bracket, a steering shaft and a pivot pin about which the outboard motor can be tilted or trimmed.

The steering shaft typically extends through the swivel bracket and is affixed to the drive unit. The steering shaft is pivotally journaled for steering movement about a generally vertically extending steering axis within the swivel bracket. The clamping bracket often includes a pair of bracket arms spaced apart from each other and affixed to the watercraft transom. The pivot pin completes a hinge coupling between the swivel bracket and the clamping bracket. The pivot pin extends through the bracket arms so that the clamping bracket supports the swivel bracket for pivotal movement about a generally horizontally extending tilt axis defined by the pivot pin.

The drive unit preferably includes a power head 32, a driveshaft housing and a lower unit. The power head 32 is disposed atop the drive unit and includes the engine 30 and a protective cowling 34. The engine 30 includes a crankshaft 36 that is an output shaft of the engine 30. The driveshaft housing depends from the power head 32 and rotatably supports a driveshaft extending generally vertically and driven by the crankshaft 36. The lower unit further depends from the driveshaft housing and rotatably supports a propulsion shaft extending generally horizontally and driven by the driveshaft through a transmission that couples the shafts together. A propeller is preferably affixed at the end of the propulsion shaft as the propulsion device. The driveshaft and the lower unit together define internal passages that form a discharge section of an exhaust system of the engine 30. At engine speed above idle, the majority of exhaust gases are discharged to the body of water surrounding the outboard motor through the internal passages.

The protective cowling 34 defines a generally closed cavity 40 in which the engine 30 is disposed. The protective cowling 34 preferably comprises a top cowling member 42 and a bottom cowling member 44. The top cowling member 42 preferably is detachably affixed to the bottom cowling member so that a watercraft operator, user, mechanic or repairperson can access the engine 30 for maintenance or for other purposes.

The engine 30 preferably operates on a four-cycle combustion principle. The illustrated engine 30 comprises a cylinder block 48. The illustrated cylinder block 48 defines two cylinder bores 50. The cylinder bores 50 extend generally horizontally and are vertically spaced from one another. A piston 52 can reciprocate in each cylinder bore 50. A cylinder head member 54 is affixed to the cylinder block 48 for closing each one end of the cylinder bores 50 to define combustion chambers 56 in combination with the cylinder bores 50 and the pistons 52. A cylinder cover member 58 is further affixed to the cylinder head member 54 so as to define a cylinder head assembly together with the cylinder head member 54.

The other end of the cylinder block 48 preferably is closed with a crankcase member 62 that at least partially defines a crankcase chamber 64. The foregoing crankshaft 36 extends generally vertically through the crankcase chamber 64. The crankshaft 36 preferably is connected to the pistons 52 by connecting rods 66 and is rotated by the reciprocal movement of the pistons 52.

As used through this description, the terms "front," "forward" and "forwardly" mean at or to the side where the crankcase member 62 is located, and the terms "rear," "rearward," "rearwardly" and "reverse" mean at or to the opposite side of the front side, unless indicated otherwise or otherwise readily apparent from the context of use.

The engine 30 includes an air induction system for introducing air to the combustion chambers 56. The air induction system preferably includes a plenum chamber member defining a plenum chamber, an intake manifold 70 defining air intake passages 72, charge formers and associated intake ports 74 formed in the cylinder head member 54. The air intake passages 72 and the intake ports 74 are associated with the respective combustion chambers 56. Intake valves 76 repeatedly open and close the intake ports 74. When the intake ports 74 are opened, the air intake passages 72 communicate with the associated combustion chambers 56.

The protective cowling 34 has an air intake opening through which the ambient air is introduced into the closed cavity 40. The air in this cavity 40 is then drawn into the air intake passages 72 through the plenum chamber. The intake passages 72 communicate with the combustion chambers 56, the air can enter these combustion chambers 56.

The charge formers are preferably located between the plenum chamber member and the intake manifold 70. In the illustrated embodiment, the charge formers include a pair of carburetors 80 each associated with each combustion chamber 56. The carburetors 80 have an air/fuel measurement mechanism. A proper amount of fuel as well as a proper amount of the air can be supplied to the combustion chambers 56 through the carburetors 80. The air and the fuel form an air/fuel charge or air/fuel mixture and normally an air/fuel ratio is fixed during every running conditions of the engine 30 so that the engine 30 operates under the optimum conditions always. The engine 30, of course, can include a fuel injection system (either direct or indirect) in the place of the carburetors 80, which are shown as one type of charge formers that can be employed.

The engine 30 also includes an exhaust system for discharging burnt charges or exhaust gases to a location outside of the outboard motor from the combustion chambers 56. Exhaust ports 84 are defined in the cylinder head member 54. Exhaust valves 86 repeatedly open and close the exhaust ports 84. When the exhaust ports 84 are opened, the combustion chambers 56 communicate with an exhaust manifold 88 which collects the exhaust gases and directs them to the foregoing internal passages defined in the driveshaft housing and the lower unit of the outboard motor.

The engine 30 is provided with a SOHC type valve cam mechanism 90 for actuating both the intake and exhaust valves 76, 86. A single camshaft 92 is journaled for rotation and extends generally vertically in the cylinder head member 54. As seen in FIG. 3, the camshaft 92 rotates clockwise in this view. The camshaft 92 is preferably made of cast iron. Both a top end and a bottom end of the cylinder head member 54 support the camshaft 92. The crankshaft 36 drives the camshaft 92 in timed relationship. The camshaft 92 has intake cam lobes 94 and exhaust cam lobes 96. In the illustrated embodiment, the intake cam lobe 94 is located above the exhaust cam lobe 96 at each cylinder bore 50. The cylinder head cover member 58 defines a camshaft chamber or valve cam mechanism chamber 97 therebetween that encloses the camshaft 92 and other relating components. In addition to the top and bottom ends of the cylinder head member 54, each middle portion of the cylinder head member 54 and the cylinder head cover member 58 together supports journals 98 of the camshaft 92. Preferably, the crankshaft 36 drives the camshaft 92 through a cam drive mechanism that comprises a drive sprocket on the crankshaft 36 and a driven sprocket 99 (FIG. 1) on the camshaft 92. A timing belt or chain is wound around the drive and driven sprockets.

As seen in FIG. 3, intake rocker arms 100 and exhaust rocker arms 101 are preferably interposed between the camshaft 92 and the respective valves 76, 86 so as to push the respective valves 76, 78 toward the combustion chambers 56 when the cam lobes 94, 96 lift the rocker arms 100, 101. That is, the valves 76, 78 are repeatedly open and closed in timed sequence with the angular position of the crankshaft 36 by rotation of the camshaft 92. The intake rocker arm 100 and the exhaust rocker arm 101 are mounted on an intake rocker arm shaft 102 and an exhaust rocker arm shaft 104, respectively, which are journaled on the cylinder head member 54, for pivotal movement. The respective rocker arm shafts 102, 104 are fulcrums for the rocker arms 100, 101. An outer end of each rocker arm 100, 101 contacts a valve tip of each valve 76, 86, while an inner end of each rocker arm 100, 101 defines a slipper portion 106 which lies on the cam lobes 94, 96.

The valves 76, 86 are seated at valve seats 108 unless the rocker arms 100, 101 push them toward the combustion chambers 56 because biasing springs 110 urge them in the opposite direction. When the valves 76, 86 are seated at the valve seats 108, the combustion chambers 56 define completely closed chambers so as to gain a necessary compression ratio in the combustion chambers 56. Under this condition, it is extremely difficult to rotate the crankshaft 36 manually because the opposing force generated by air or air/fuel charge filling the combustion chambers 56 is almost beyond human power. The illustrated engine 30, however, has a manually operated starter assembly 112 (FIG. 2) that is assisted by a decompression mechanism 114. The manually operated starter assembly 112 and the decompression mechanism 114 will be described in great detail shortly.

The engine 30 further includes an ignition or firing system. Each combustion chamber 50 is provided with a spark plug. The spark plug has electrodes exposed into the associated combustion chamber 56 and ignites an air/fuel charge at a selected ignition timing. The ignition system preferably has an ignition coil and an igniter which are connected to an electrical system such as an ECU (electronic control unit) so that an ignition timing can be controlled by the electrical system. In order to enhance and maintain good performance of the engine 30, the ignition timing can be advanced or delayed in response to various engine running conditions.

The engine 30 accumulates heat in, for example, the cylinder block 48, the cylinder head member 54 and exhaust portions. Water jackets 118 are preferably provided for cooling at least these engine portions 48, 54 and exhaust system portions. Cooling water is introduced from the body of water surrounding the outboard motor 30 and is then discharged there.

A flywheel assembly is affixed atop the crankshaft 36. The flywheel assembly includes an AC generator or flywheel magneto that supplies electric power to electrical components including the fuel injection system.

In the illustrated embodiment, the manually operated starter assembly 112 is combined with the flywheel assembly. Any conventional manual starters can be applied as the manually operated starter assembly 112. The engine 30 preferably employs a conventional recoil starter that includes a starter handle 122. The starter handle 122 protrudes forwardly not only from the starter assembly 112 but also from the top cowling member 42 so that the watercraft operator can pulls it forwardly. A coiled rope is provided within the starter assembly 112 and couples the starter handle 122 with the flywheel assembly in a manner that is well known. Because the flywheel assembly is coupled with the crankshaft 36, when the operator pulls the handle 122, the rope rotates the crankshaft 36 and the engine 30 can starts accordingly. Then, the operator releases the handle 122 and the rope returns to the initial position with an action of a recoiling mechanism.

As noted above, it is extremely difficult to rotate the crankshaft 36 manually due to the high opposing force generated by the air or air/fuel charge filling the combustion chambers 56. The decompression mechanism 114 is thus provided for helping the operator start the engine 30.

With primary reference to FIGS. 4–9, the decompression mechanism 114 will now be described in great detail. In the illustrated embodiment, the engine 30 includes two decompression mechanisms 114 each associated with each one of the exhaust valves 86. Each decompression mechanism 114 includes a decompression actuator 130 located under each exhaust lobe 96. The actuators 130 are affixed to the camshaft 92 for pivotal movement about a pivot axis extending generally normal to an axis 131 (FIGS. 7 and 8) of the camshaft 92.

Each actuator 130 is configured generally as the letter U in the plan views shown in FIGS. 5(*a*) and 5(*c*), and also in the front end view (as to the upper actuator 130) or rear end view (as to the lower actuator 130) both shown in FIG. 5(*d*). That is, the actuator 130 has a pair of side portions 132 and a bridge portion 134 which couples the side portions 132 together by straddling over the body of the camshaft 92.

The respective side portions 132 have apertures 136 at each middle portion. The camshaft 92 defines also a pair of through-holes, each positioned under the respective exhaust cam lobes 96 and extending normal to the axis 131 of the camshaft 92. Pivot shafts 138 extend through the apertures 136 and the through-holes to affix the respective actuators 130 for pivotal movement on the camshaft 92. Preferably, the pivot shafts 138 are press-fitted into the through-holes. The actuators 130 accordingly can pivot about the pivot axes. The pivot shafts 138 thus act as fulcrums.

Figure 4:
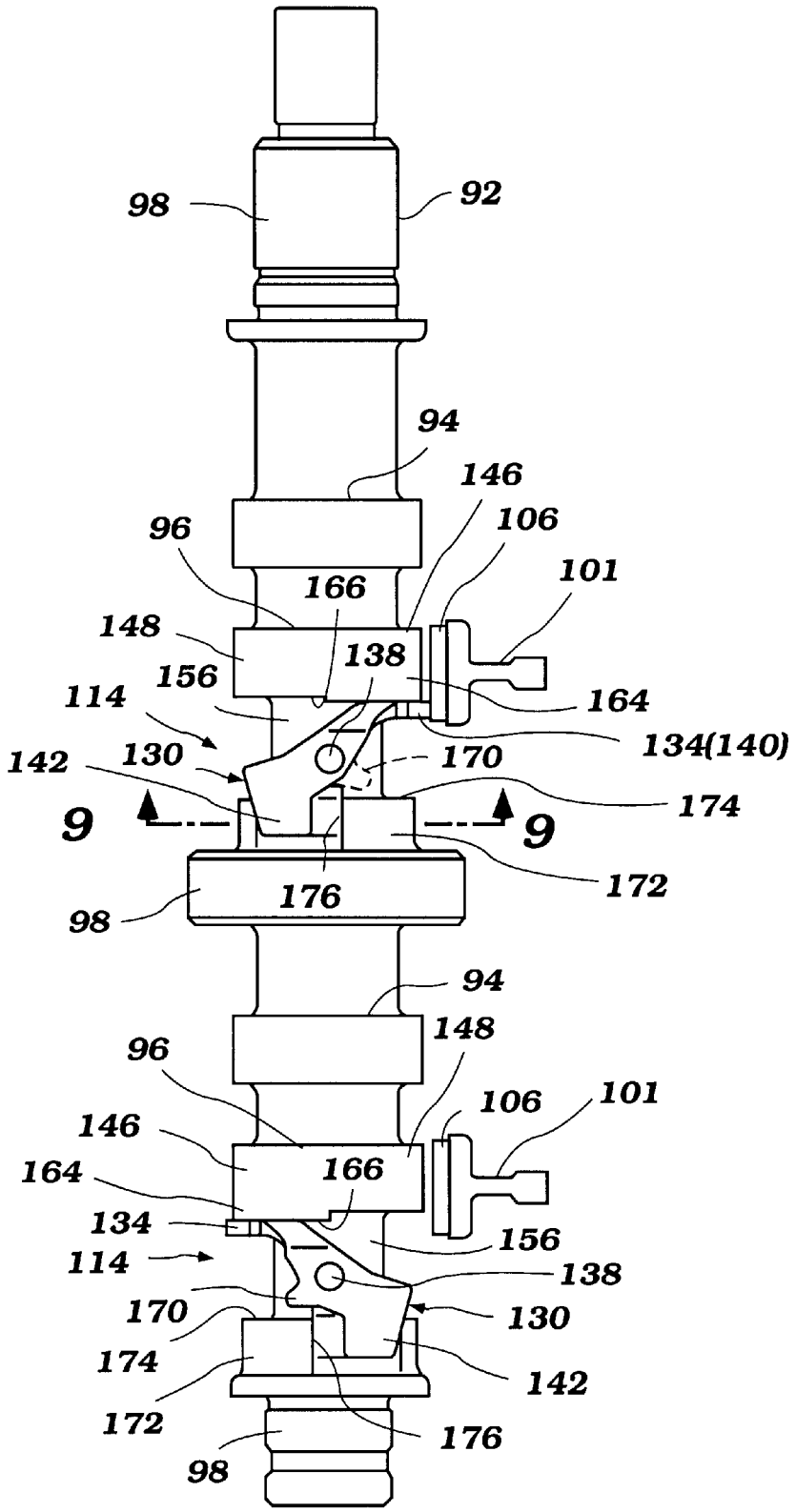
FIG. 4 is an enlarged side view of a camshaft on which the decompression mechanism is provided. In this figure, the camshaft is illustrated under a condition in which the engine stands still or is starting.
Figure 5A:
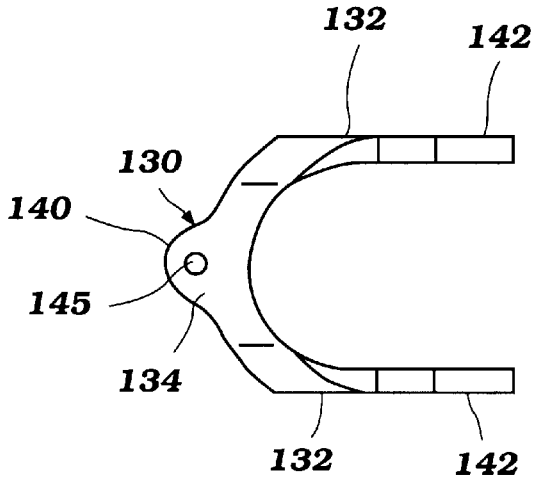
FIG. 5 includes various views of a decompression actuator. In particular, FIG. 5(*a*) is a top plan view, FIG. 5(*b*) is a side view, FIG. 5(*c*) is a bottom plan view and FIG. 5(*d*) is an end view of the decompression actuator.
Figure 5D:
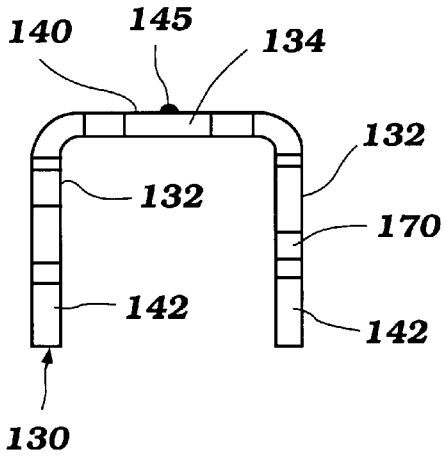
Figure 5B:
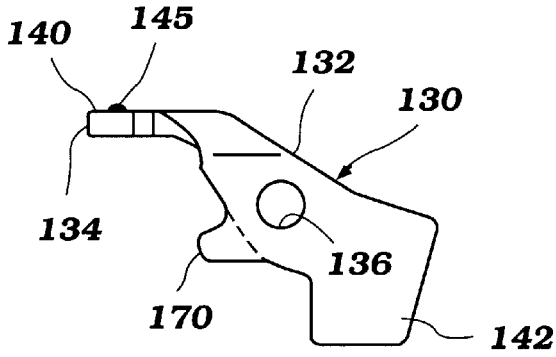
Figure 5C:
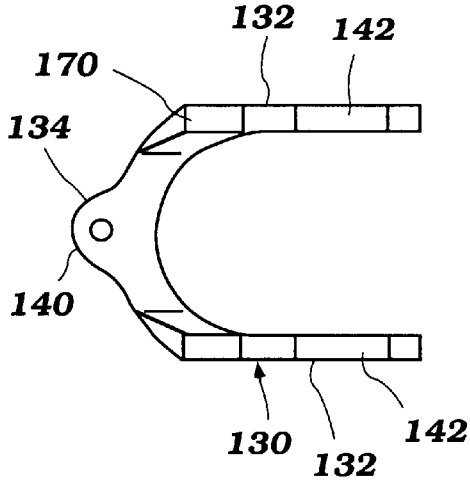

Each lower part of the side portions 132, which are located lower than the aperture 136, has larger mass than the upper rest part of the side portions 132. That is, the total mass of both the lower parts of the side portions 132 is larger than the total mass of the upper parts of the side portions 132 plus the bridge portion 134. In the illustrated embodiment, the upper part of the side portions 132 and the bridge portion 134 define a holder section 140, while both of the lower part of the side portions 132 define weight sections 142. The holder section 140 preferably has a cam configuration as best seen in FIGS. 5(*a*) and (*c*). The weight sections 142 place at a lowered position as shown in FIG. 4 when the camshaft 92 does not rotate, i.e., the engine 30 stand still.

This lowered position is an initial position of the decompression mechanism 114.

Each upper surface of the bridge portion 134 of the actuators 130 preferably has a projection 145 formed thereon and abuts on a lower surface of the exhaust cam lobe 96 at this projection 145 when the decompression mechanism 114 is in the initial position. The actuators 130 are preferably made of sheet metal by a punching and press method using a die. The projection 145 also can be formed in the punching and press processes. Other methods such as casting and forging are also practicable.

Figure 8:
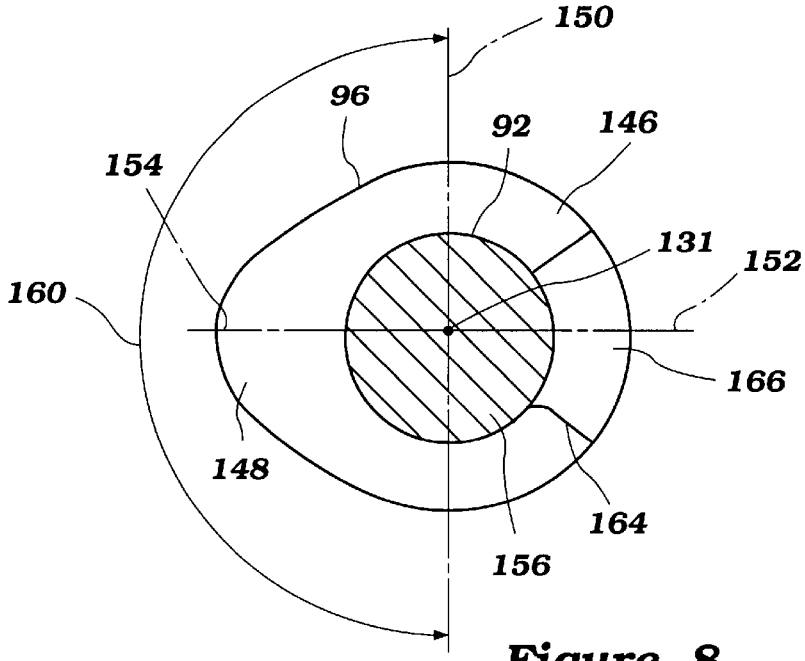
FIG. 8 is a cross-sectional view of the camshaft taken along the line 8—8 of FIG. 7.

As best seen in FIG. 8, each exhaust cam lobe 96 has a base circle portion 146 and a nose portion 148. Each base circle portion 146 has a diameter which defines the base circle of the cam lobe 96. Each nose portion 148 protrudes from the base circle so as to lift the associated slipper portion 106 of the rocker arm 101. In the illustrated embodiment, the base circle portion 146 and the nose portion 148 are divided from each other by a plane 150, which includes the camshaft axis 131 and is normal to another plane 152 that also includes the camshaft axis 131 and an apex 154 of the nose portion 148. The diameter of the base circle portion 146 is larger than a diameter of a shaft portion 156 of the camshaft 92. The apex 154 of the nose portion 148 extends radially from the base circle, which defines an outer surface of the base circle portion 146. In normal engine operations, the nose portion 148 lifts the slipper portion 106 of the exhaust rocker arm 101 so as to open the exhaust valve 86. The intake cam lobe 94 has generally the same configuration as the exhaust cam lobe 96.

The camshaft 92 is preferably manufactured by a casting method. The half area of each exhaust cam lobe 96 including the nose portion 148, which is designated by the reference numeral 160 of FIG. 8, is preferably hardened so as to be harder than the other half area that defines the base circle portion 146. This is because the nose portion 148 repeatedly contacts the slipper portion 106 of the rocker arm 101 and hence it is necessary to preclude the nose portion 148 from being worn. In the illustrated embodiment, the area is hardened in a chilled casting process. In this method, the casting is done under the condition that a metal mold is attached at the nose portion 148 so as to sudden cool the nose portion 148. The nose portion 148 thus becomes hardened (i.e., white pig iron).

As best seen in FIG. 8, a plateau or projection 164 is formed at a surface in the area of the base circle portion 146. The plateau 164 protrudes from the lower surface with a small height so as to form a flat surface 166 which extends generally in parallel to the rest of the lower surface. The plateau 164 is positioned generally opposite to the apex 154 relative to the plane 150 and extends so as to have a certain area. Preferably, the flat surface 166 of the plateau 164 is finished by a machining process. Because the base circle portion 146 in this embodiment is not hardened and hence softer than the nose portion 148, the machining can be done easily. The flat surface 166 defines a positioning surface for the projection 146 of the holder section 140.

The projection 145 abuts on the flat surface 166 of the plateau 164. At the same time, a tip or apex portion of the bridge portion 134 abuts on the slipper portion 106 of the exhaust rocker arm 101 so as to prevent the slipper portion 106 from contacting with the cam lobe 96. Since the surface 166 is machined, a space between the cam lobe 96 and the slipper portion 106 of the rocker arm 101 can be accurately kept so that an optimal decompression function is assured.

During the rotation of the camshaft 92, the actuators 130 pivot about the pivot axes of the pivot shafts 138 due to the centrifugal force generated by the rotation. If the actuators 130 move without any regulation, the weight sections 142 can move upwardly and then interfere with the rocker arms 101. The interference of the weight sections 142 with the rocker arms 101 can prevent the slipper portions 106 from following the cam lobes 96 properly. The decompression mechanisms 114 therefore include stopper units.

Figure 6:
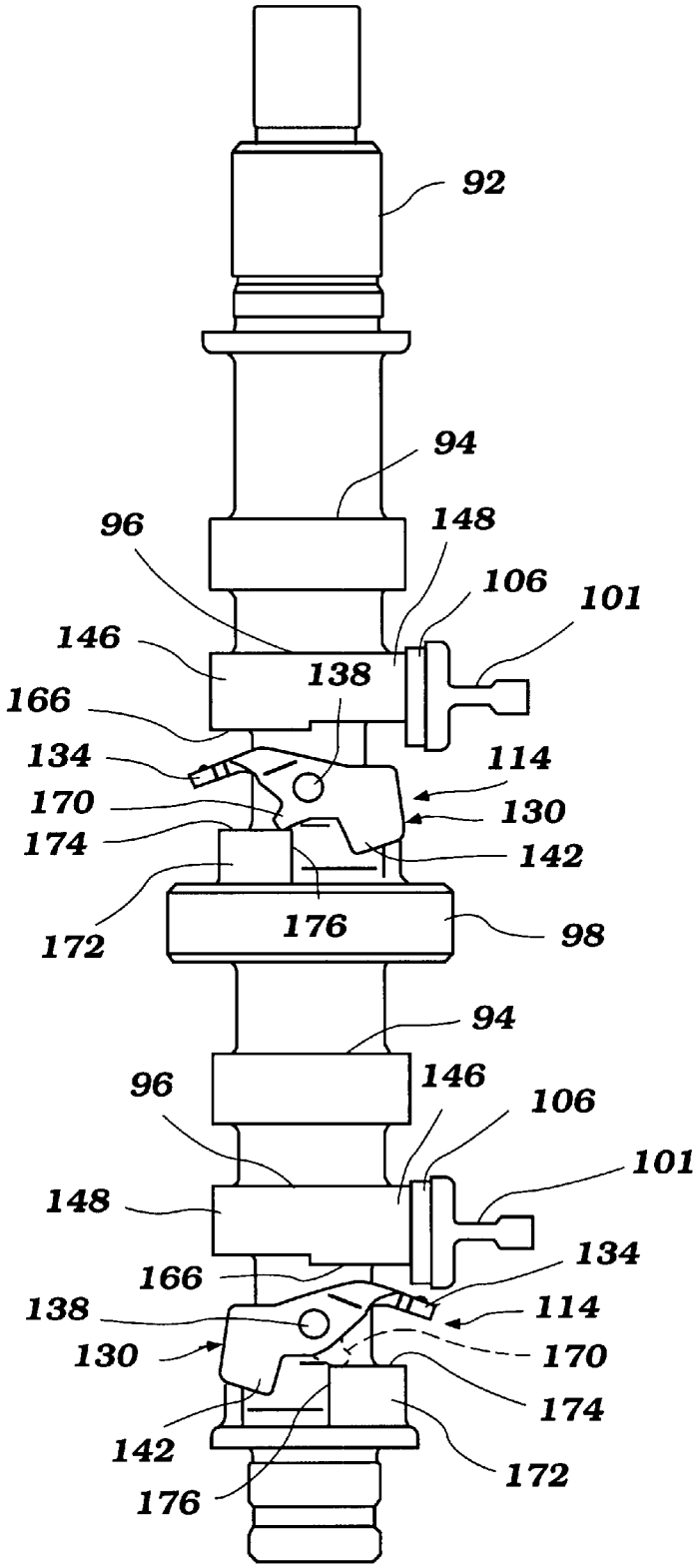
FIG. 6 is the same enlarged side view as that shown in FIG. 4 except illustrating the camshaft under a condition in which the engine is running.
Figure 7:
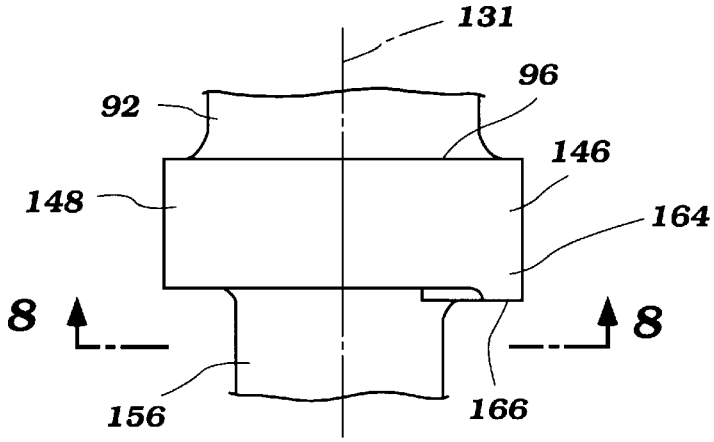
FIG. 7 is an enlarged partial view of the camshaft showing a cam lobe for an exhaust valve.

As seen in FIGS. 4 and 6, each stopper unit preferably comprises a stopper section 170 formed at the actuator 130 and a circular projection 172 formed around the camshaft 92. The stopper section 170 preferably extends from one of the side portions 132, specifically, at a portion thereof adjacent to the pivot shaft 138. The circular projection 172 for the upper decompression mechanism 114 extends from the middle journal 98 which is located at a middle portion of the camshaft 92. Another circular projection 172 for the lower decompression mechanism 114 is formed on the camshaft 92. Both of the circular projections 172 have a diameter larger than the diameter of the shaft portion 156 of the camshaft 92 so that the stopper sections 170 can contact top surfaces 174 of the circular projections 172. The circular projections 172 are formed by the casting method along with the other part of the camshaft 92. The top surfaces 174 of the circular projections 172 accurately define positioning surfaces for the stopper sections 170 and thus are preferably finished by a machining process, like the flat surfaces 166 of the cam lobes 96.

Figure 9:
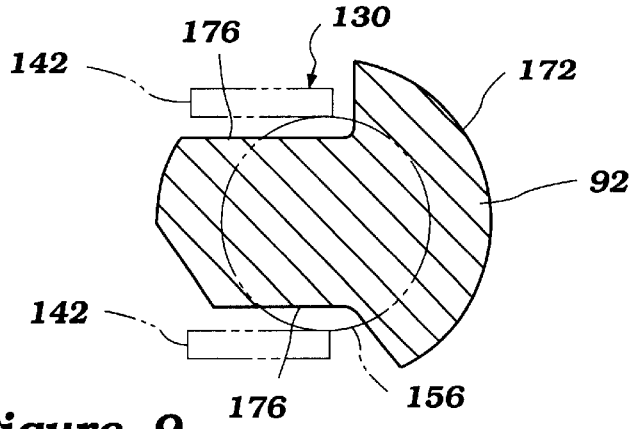
FIG. 9 is a cross-sectional view of the camshaft taken along the line 9—9 of FIG. 4.

As seen in FIGS. 4, 6 and 9, each circular projection 172 defines a pair of cuts or reliefs 176 where the weight sections 142 of the actuator 130 can nest when the actuator 130 is in the initial position. With the pivotal movement of the actuators 130 by the centrifugal force, the top surfaces of the circular projections 172 inhibit the stopper sections 170 from rotating further. The weight sections 142 therefore never interferes with the slipper portions 106 of the rocker arms 101.

As seen in FIG. 4, when the camshaft 92 stands still or is driven by the crankshaft 36 at an engine speed smaller than a predetermined speed (i.e. slow speed rotation occurs when the operator pulls the starter handle 122), the holder sections 140, and more specifically, the projections 146 abut the flat surfaces 166 of the exhaust cam lobes 96. The predetermined speed can be selected, for example, between 400 rpm and 500 rpm and can preferably be 450 rpm. At the same time, the holder sections 140 hold the exhaust rocker arms 101 so that the exhaust valves 86 are not seated on the valve seats 108. This is because the weight sections 142 are lowered due to gravity. That is, the actuators 130 are placed in the initial position.

Under this condition, the pressure in the combustion chambers 56 is generally equal to the atmospheric pressure because the combustion chambers 56 communicate with the atmosphere through the spaces defined between the valves 86 and the valve seats 108. The pistons 52 thus can reciprocate freely without generating any force acting against the rotation of the crankshaft 36. The operator can operate the manual starter assembly 112 or can pulls the starter handle 122 easily and the engine 30 starts accordingly.

With the engine 30 starting, the crankshaft 36 drives the camshaft 92 through the cam drive mechanism. As seen in FIG. 6, when the engine speed exceeds the foregoing predetermined speed, the actuators 130, the actuators 130 pivot about the pivot axes 138 because the weight sections 142 swing upwardly by the centrifugal force exerted upon the weight sections 142. With this pivotal movement of the actuators 130, the holder sections 140 move away from the flat surfaces 166 of the cam lobes 96 and hence the holder sections 140 no longer hold the rocker arms 101. The slipper portions 106 of the rocker arms 101 thus abut on the cam lobes 96 and follow the configuration of the cam lobes 96. In the meantime, the stopper sections 170 of the actuators 130 contact with the top surfaces 174 of the circular projections 172 so as to prevent the actuators 130 from swinging further. When the engine speed exceeds the predetermined speed, the actuators 130 are kept in this detached position. The holder sections 140 thus never interfere with the rocker arms 101 once the engine has started.

As described above, in the illustrated embodiment, each base circle portion 146 of the cam lobe 96, i.e., the half area that includes the plateau 164, is not hardened. The plateau 164 thus is not too hard to be easily machined and the positioning surface, i.e., the flat surface 166, can be formed easily by a machining process. In addition, the plateau 164 can define the minimum area where the holder section 140 abuts. The machining process is only required on this small area. The manufacturing cost of the decompression mechanism 114 is therefore minimized even if the mechanism 114 employs the arrangement in which the holder section 140 reclines on the cam lobe 96.

In the illustrated embodiment, the exhaust valves 86 are positioned below the intake valves 76. This is advantageous because the carburetors 80 can be placed at relatively high positions and the space below the carburetors are available for other engine related components without interfering with the carburetors 80. The contrary arrangement, however, is also applicable. That is, the intake valves 76 can be positioned below the exhaust valves 86.

The rocker arms can be removed if other cam drive mechanisms are applied. For instance, the DOHC (Double Over Head Camshaft) type mechanism can exclude the rocker arms because a pair of camshafts can directly actuate intake valves and exhaust valves. In this arrangement, the holder sections of the actuators directly hold the valves.

The decompression actuators can hold the intake valves instead of the exhaust valves.

In the illustrated embodiment, the nose portion of the cam lobe occupies generally the half area thereof. This proportion or percentage to the entire area is changeable. For example, areas 30%, 40% and 60% are all applicable inasmuch as the area includes the nose apex and excludes the projection.

The body of the camshaft itself can be also made by the forging method.

Of course, the foregoing description is that of a preferred embodiment of the present invention, and various changes and modifications may be made without departing from the spirit and scope of the invention, as defined by the appended claims.

What is claimed is:

1. An internal combustion engine comprising a cylinder block defining at least one cylinder bore, a piston reciprocating in the cylinder bore, a cylinder head member closing one end of the cylinder bore and defining a combustion chamber with the cylinder bore and the piston, an intake passage having an intake port through which air is introduced into the combustion chamber, an intake valve arranged to open and close the intake port, an exhaust passage having an exhaust port through which exhaust products are discharged from the combustion chamber, an exhaust valve arranged to open and close the exhaust port, at least one camshaft extending generally vertically, the camshaft being arranged for rotation and having cam lobes to actuate the intake valve and the exhaust valve, and a decompression actuator affixed to the camshaft for pivotal movement about a pivot axis extending generally normal to an axis of the camshaft, the actuator including a holder section and a weight section, the holder section being arranged to hold the intake valve or the exhaust valve in an open position when the actuator exists in an initial position, the weight section being disposed opposite to the holder section relative to the pivot axis so as to place the holder section in the initial position, the actuator pivoting when the weight section moves by centrifugal force produced by the rotation of the camshaft so as to release the holder section from the initial position, the actuator and the camshaft together defining means for inhibiting the actuator from pivoting beyond a preset range, at least the cam lobe associated with the intake valve or the exhaust valve held by the holder section including a base circle portion and a nose portion, the base portion having a diameter which defines the base circle of the cam lobe, the nose portion protruding from the base circle so as to lift the associated intake valve or the exhaust valve, the nose portion being cured so as to be harder than the base circle portion, the base circle portion defining a surface projecting toward the actuator, the holder section abutting on the surface when the actuator lies in the initial position, and the surface being finished by a machining process.

2. A valve cam mechanism for a four-cycle engine having a combustion chamber, comprising a valve arranged to open and close the combustion chamber to the atmosphere, a camshaft extending generally vertically, the camshaft being arranged for rotation and having a cam lobe to actuate the valve, and a decompression actuator affixed to the camshaft for pivotal movement about a pivot axis extending generally normal to an axis of the camshaft, the actuator including a holder section and a weight section, the holder section being arranged to hold the valve in an open position when the actuator exists in an initial position, the weight section being disposed opposite to the holder section relative to the pivot axis so as to place the holder section in the initial position, the actuator pivoting when the weight section moves by centrifugal force produced by the rotation of the camshaft so as to release the holder section from the initial position, the actuator and the camshaft together defining means for inhibiting the actuator from pivoting beyond a preset range, the cam lobe including a base circle portion and a nose portion, the base circle portion having a diameter which defines the base circle of the cam lobe, the nose portion protruding from the base circle so as to lift the associated valve, the nose portion being cured so as to be harder than the base circle portion, the base circle portion defining a surface projecting toward the actuator, the holder section abutting on the surface when the actuator lies in the initial position, and the surface being finished by a machining process.

3. An internal combustion engine comprising a cylinder block defining at least one cylinder bore, a piston reciprocating in the cylinder bore, a cylinder head member closing one end of the cylinder bore and defining a combustion chamber with the cylinder bore and the piston, an intake passage having an intake port through which air is introduced into the combustion chamber, an intake valve arranged to open and close the intake port, an exhaust passage having an exhaust port through which exhaust products are discharged from the combustion chamber, an exhaust valve arranged to open and close the exhaust port, at least one camshaft extending generally vertically, the camshaft being arranged for rotation and having cam lobes to actuate the intake valve and the exhaust valve, and a decompression actuator affixed to the camshaft for pivotal movement about a pivot axis extending generally normal to an axis of the camshaft, the actuator including a holder section, a weight section and a stopper section, the holder section being arranged to hold the intake valve or the exhaust valve in an open position when the actuator exists in an initial position, the weight section being disposed opposite to the holder section relative to the pivot axis so as to place the holder section in the initial position, the actuator pivoting when the weight section moves by centrifugal force produced by the rotation of the camshaft so as to release the holder section from the initial position, the camshaft further having a projection extending radially from the camshaft and defining a first surface on which the stopper section abuts so as to inhibit the actuator from pivoting beyond a preset range, at least the cam lobe associated with the intake valve or the exhaust valve held by the holder section including a base circle portion and a nose portion, the base circle portion having a diameter which defines the base circle of the cam lobe, the nose portion protruding from the base circle so as to lift the associated intake valve or the exhaust valve, the nose portion being cured so as to be harder than the base circle portion, the base circle portion defining a second surface projecting toward the actuator, the holder section abutting on the second surface when the actuator lies in the initial position, and the second surface being finished by a machining process.

4. The internal combustion engine as set forth in claim 3, wherein the camshaft is made by casting, and the nose portion is hardened in a chill casting process.

5. The internal combustion engine as set forth in claim 3, wherein the nose portion and the base circle portion are divided from each other by a plane generally lying at the center of the camshaft and being normal to another plane that generally includes the axis of the camshaft and an apex of the nose portion.

6. The internal combustion engine as set forth in claim 3, wherein the first surface of the projection is finished by a machining process.

7. The internal combustion engine as set forth in claim 3, wherein the second surface is partly defined in an area of the base circle portion, and the area is generally positioned oppositely to an apex of the nose portion relation to the axis of the camshaft.

8. The internal combustion engine as set forth in claim 3, wherein the holder section has a projection abutting on the second surface of the base circle portion.

9. The internal combustion engine as set forth in claim 3, wherein the camshaft further has at least one journal whereby the camshaft is rotatably journaled on the cylinder head member, and the projection extends from the journal toward the actuator.

10. The internal combustion engine as set forth in claim 3 additionally comprising rocker arms coupled to the cylinder head member for pivotal movement, wherein the camshaft actuates the intake and exhaust valves via the respective rocker arms, each one of the rocker arms has a slipper portion arranged to contact with one of the cam lobes, each one of the rocker arms pushes the intake valve or the exhaust valve when the slipper portion is lifted by one of the cam lobes, and the holder section holds the slipper portion in a lifted position instead of the cam lobe when the actuator exists in the initial position.

11. The internal combustion engine as set forth in claim 3, wherein the stopper section is positioned adjacent to the pivot axis.

12. The internal combustion engine as set forth in claim 3, wherein the engine powers a marine propulsion device.

* * * * *

UNITED STATES PATENT AND TRADEMARK OFFICE

CERTIFICATE OF CORRECTION

PATENT NO. : 6,386,168 B2
DATED : May 14, 2002
INVENTOR(S) : Suzuki et al.

It is certified that error appears in the above-identified patent and that said Letters Patent is hereby corrected as shown below:

Title page,
Insert item [73], to read as follows:
-- [73] Assignee: Sanshin Kogyo Kabushiki Kaisha --

Signed and Sealed this

Twelfth Day of August, 2003

JAMES E. ROGAN
*Director of the United States Patent and Trademark Office*